US009321105B2

(12) United States Patent
Yamaji et al.

(10) Patent No.: US 9,321,105 B2
(45) Date of Patent: Apr. 26, 2016

(54) CLAY-LIKE COMPOSITION FOR FORMING SINTERED COPPER BODY, POWDER FOR CLAY-LIKE COMPOSITION FOR FORMING SINTERED COPPER BODY, METHOD OF MANUFACTURING CLAY-LIKE COMPOSITION FOR FORMING SINTERED COPPER BODY, SINTERED COPPER BODY, AND METHOD OF MANUFACTURING SINTERED COPPER BODY

(75) Inventors: Takashi Yamaji, Sanda (JP); Yoshifumi Yamamoto, Kobe (JP); Yasuo Ido, Kobe (JP); Shinji Otani, Sanda (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 1196 days.

(21) Appl. No.: 13/298,515

(22) Filed: Nov. 17, 2011

(65) Prior Publication Data

US 2012/0128523 A1 May 24, 2012

(30) Foreign Application Priority Data

Nov. 18, 2010 (JP) ..... 2010-257850
Oct. 14, 2011 (JP) ..... 2011-226902

(51) Int. Cl.
*B22F 3/10* (2006.01)
*C22C 32/00* (2006.01)

(52) U.S. Cl.
CPC ..... *B22F 3/1007* (2013.01); *C22C 32/0021* (2013.01); *B22F 2999/00* (2013.01)

(58) Field of Classification Search
None
See application file for complete search history.

(56) References Cited

U.S. PATENT DOCUMENTS

| | | | | | |
|---|---|---|---|---|---|
| 3,929,674 | A | * | 12/1975 | Patterson | 75/247 |
| 5,035,837 | A | * | 7/1991 | Saeki et al. | 252/512 |
| 5,087,413 | A | * | 2/1992 | Abe | 419/9 |
| 5,120,473 | A | * | 6/1992 | Kondo et al. | 252/512 |
| 5,230,846 | A | * | 7/1993 | Tamhankar et al. | 156/89.18 |
| 5,702,501 | A | * | 12/1997 | Osawa et al. | 75/255 |
| 6,909,185 | B1 | * | 6/2005 | Kondo et al. | 257/746 |
| 2008/0083909 | A1 | * | 4/2008 | Sato et al. | 252/512 |

FOREIGN PATENT DOCUMENTS

| | | | |
|---|---|---|---|
| JP | 09-071802 | A | 3/1997 |
| JP | 2002-212603 | A | 7/2002 |
| JP | 2003-049208 | A | 2/2003 |

* cited by examiner

*Primary Examiner* — Jessee Roe
*Assistant Examiner* — Ngoclan T Mai
(74) *Attorney, Agent, or Firm* — Locke Lord LLP; James E. Armstrong, IV; Nicholas J. DiCeglie, Jr.

(57) ABSTRACT

A clay-like composition for forming a sintered copper body of the present invention includes a powder constituent containing a copper-containing metal powder which contains copper and a copper-containing oxide powder which contains copper; a binder; and water, wherein the amount of oxygen contained in the powder constituent is in a range of from 4 mass % to 8 mass %.

19 Claims, 2 Drawing Sheets

CLAY-LIKE COMPOSITION FOR FORMING SINTERED COPPER BODY, POWDER FOR CLAY-LIKE COMPOSITION FOR FORMING SINTERED COPPER BODY, METHOD OF MANUFACTURING CLAY-LIKE COMPOSITION FOR FORMING SINTERED COPPER BODY, SINTERED COPPER BODY, AND METHOD OF MANUFACTURING SINTERED COPPER BODY

BACKGROUND OF THE INVENTION

1. Field of the Invention

The present invention relates to a clay-like composition for forming a sintered copper body, powder for the clay-like composition for forming a sintered copper body, a method of manufacturing the clay-like composition for forming a sintered copper body, a sintered copper body obtained from the clay-like composition for forming a sintered copper body, and a method of manufacturing the sintered copper body.

Priority is claimed on Japanese Patent Application No. 2010-257850, filed Nov. 18, 2010, and Japanese Patent Application No. 2011-226902, filed Oct. 14, 2011, the amount of which is incorporated herein by reference.

2. Description of Related Art

In the past, jewelry, artistic handcrafts, and the like made of copper represented by, for example, a ring or the like, have been manufactured by casting or forging a copper-containing material in general. However, in recent years, copper clay (clay-like composition for forming a sintered copper body) containing copper powder has become commercially available, and a method has been suggested for manufacturing jewelry or artistic handcrafts made of copper having an arbitrary shape by making the copper clay into an arbitrary shape and then baking the copper clay (for example, see Patent Documents 1 to 3).

The copper clay described-above can be freely shaped in the same manner as in general clay work, and it is possible to very simply manufacture jewelry, artistic handcrafts and the like made of copper by drying a shaped body obtained by shaping and then baking the shaped body using a furnace.

This type of copper clay is obtained by adding a binder and water and optionally further adding fatty substance or a surface active agent or the like to the pure copper powder and then kneading the mixture.

Patent Document 1: Japanese Unexamined Patent Application, First Publication No. H09-071802

Patent Document 2: Japanese Unexamined Patent Application, First Publication No. 2002-212603

Patent Document 2: Japanese Unexamined Patent Application, First Publication No. 2003-049208

SUMMARY OF THE INVENTION

When the above-described copper clay is baked in a non-oxidizing atmosphere, it is necessary to perform pre-baking in the atmosphere to combust and remove the binder.

In addition, when a flux of borax or the like is added to the copper clay, and the copper clay is baked in the atmosphere, it is necessary to rapidly cool the sintered copper body of a high temperature, since there is a concern that an oxide film generated on the surface of the sintered copper body may be dispersed if the sintered copper body of a high temperature is left as it is.

As such, the copper clay used in the related art is difficult to bake in a simple manner.

The present invention has been made in consideration of the above-described circumstances, and an object thereof is to provide a clay-like composition for forming a sintered copper body (copper clay) that can be subjected to main baking in a non-oxidizing atmosphere without being subjected to a pre-baking step in the atmosphere, powder for the clay-like composition for forming a sintered copper body, a method of manufacturing the clay-like composition for forming a sintered copper body, a sintered copper body, and a method of manufacturing the sintered copper body.

The present inventor made a thorough investigation to solve the above problems. As a result, regarding the powder for copper clay (powder for the clay-like composition for forming a sintered copper body) constituting the copper clay (clay-like composition for forming a sintered copper body), the inventor found that, by constituting the powder as mixed powder containing copper-containing metal powder which contains copper and copper-containing oxide powder which contains copper, it is possible to combust and remove the binder even if the copper clay (clay-like composition for forming a sintered copper body) is baked in the non-oxidizing atmosphere, and to omit the pre-baking performed in the atmosphere.

The present invention has been made based on this finding and has the following constitution.

A clay-like composition for forming a sintered copper body of the present invention includes a powder constituent containing a copper-containing metal powder which contains copper and a copper-containing oxide powder which contains copper; a binder; and water, wherein the amount of oxygen contained in the powder constituent is in a range of from 4 mass % to 8 mass %.

In the clay-like composition for forming a sintered copper body having this constitution, the oxygen amount is 4 mass % or more in the powder constituent containing a copper-containing metal powder which contains copper and a copper-containing oxide powder which contains copper. Accordingly, it is possible to combust the binder by using this oxygen, and it is not necessary to perform the pre-baking in the atmosphere. That is, in the main baking step performed in the non-oxidizing atmosphere, it is possible to combust and remove the binder.

Moreover, since the oxygen amount is 8 mass % or less, copper oxide is suppressed from remaining inside the sintered copper body.

In addition, since the main baking is performed in the non-oxidizing atmosphere, it is possible to suppress the generation of an oxide film on the surface of the manufactured sintered copper body, and to prevent problems such as dispersing of the oxide film in advance.

Herein, the amount of Fe in the whole clay-like composition is preferably 1000 ppm or less, and more preferably 200 ppm or less.

If the amount of Fe in the whole clay-like composition is 1000 ppm or less, a sintering property of the copper clay tends to improve.

As the copper-containing oxide powder, CuO powder is used. The amount of the CuO powder in the powder constituent is preferably in a range of from 20 mass % to 40 mass %.

Alternatively, as the copper-containing oxide powder, $Cu_2O$ powder is used. The amount of the $Cu_2O$ powder in the powder constituent is preferably in a range of from 36 mass % to 71 mass %.

In these cases, it is possible to set the amount of oxygen in the powder constituent to from 4 mass % to 8 mass %, and to combust and remove the binder in the baking step performed in the non-oxidizing atmosphere. Moreover, the copper oxide is suppressed from remaining inside the sintered copper body, so it is possible to manufacture a high quality sintered copper body.

A mixing ratio (mass ratio) B/A between the powder constituent (A) and the binder and water (B) is preferably in a range of $2/10 \leq B/A \leq 3/10$.

In this case, since the mixing ratio (mass ratio) B/A between the powder constituent (A) and the binder and water (B) is in a range of $2/10 \leq B/A \leq 3/10$, formability is secured. In addition, the binder is not included more than is necessary, and it is possible to reliably remove the binder by using oxygen contained in the powder constituent.

The particle diameter of the copper-containing oxide powder is preferably from 1 μm to 25 μm.

In addition, the average particle diameter of the copper-containing metal powder is preferably from 1 μm to 25 μm.

In these cases, since the particle diameter of the copper-containing metal powder and the copper-containing oxide powder is 25 μm or less, the sintering property of the powder is secured, and it is possible to manufacture a sintered copper body having excellent mechanical properties. Moreover, since the particle diameter of the copper-containing metal powder and the copper-containing oxide powder is 1 μm or more, it is possible to suppress the manufacturing costs of the copper-containing metal powder and the copper-containing oxide powder to be low.

To the clay-like composition for forming a sintered copper body, at least any one of fatty substance and a surface active agent may be optionally further added.

The binder of the clay-like composition for forming a sintered copper body may be constituted with a combination of at least 1 or 2 or more kinds among a cellulose-based binder, a polyvinyl compound-based binder, an acryl compound-based binder, a wax-based binder, a resin-based binder, starch, gelatin, and flour. Among these, the binder is most preferably constituted with the cellulose-based binder, particularly water-soluble cellulose.

There is no particular limitation on the type of the surface active agent, and normal surface active agents (for example, polyethylene glycol and the like) can be used.

Examples of the fatty substance include an organic acid (oleic acid, stearic acid, phthalic acid, palmitic acid, sebacic acid, acetylcitric acid, hydroxybenzoic acid, lauric acid, myristic acid, caproic acid, enanthic acid, butyric acid and capric acid), an organic acid ester (an organic acid ester including a methyl group, an ethyl group, a propyl group, a butyl group, an octyl group, a hexyl group, a dimethyl group, a diethyl group, an isopropyl group or an isobutyl group), higher alcohols (octanol, nonanol, and decanol), polyhydric alcohols (glycerin, arabinitol, and sorbitan), and an ether (dioctyl ether and didecyl ether).

The powder for the clay-like composition for forming a sintered copper body contains copper-containing metal powder which contains copper and copper-containing oxide powder which contains copper, wherein the oxygen amount is in a range of from 4 mass % to 8 mass %.

In the powder for the clay-like composition for forming a sintered copper body, CuO powder is used as the copper-containing oxide powder, and the amount of the CuO powder is preferably in a range of from 20 mass % to 40 mass %.

Alternatively, $Cu_2O$ powder is used as the copper-containing oxide powder, and the amount of the $Cu_2O$ powder is preferably in a range of from 36 mass % to 71 mass %.

The average particle diameter of the copper-containing oxide powder is preferably from 1 μm to 25 μm.

In addition, the average particle diameter of the copper-containing metal powder is preferably from 1 μm to 25 μm.

According to the powder for the clay-like composition for forming a sintered copper body having this constitution, it is possible to constitute the clay-like composition for forming a sintered copper body described above.

In the method of manufacturing the clay-like composition for forming a sintered copper body of the present invention, a copper-containing metal powder which contains copper, a copper-containing oxide powder which contains copper, a binder, and water are mixed together.

According to the method of manufacturing the clay-like composition for forming a sintered copper body having this configuration, it is possible to manufacture the clay-like composition for forming a sintered copper body that includes the copper-containing oxide powder containing copper and makes it possible to combust the binder by using oxygen of the copper-containing oxide powder.

The amount of Fe in powder constituent of clay-like composition is preferably 1000 ppm or less.

If the amount of Fe in powder constituent of clay-like composition is 1000 ppm or less, a sintering property of the copper clay tends to improve.

The sintered copper body of the present invention is obtained by baking the clay-like composition for forming a sintered copper body.

The sintered copper body having this constitution is obtained by baking the clay-like composition for forming a sintered copper body constituted in the above-described manner. Accordingly, the copper oxide or the binder does not remain inside the sintered copper body, so the quality of the sintered copper body becomes excellent.

According to the method of manufacturing the sintered copper body of the present invention, the clay-like composition for forming a sintered copper body is made into an arbitrary shape to obtain an object, and the object is dried and then baked in a reduction atmosphere or a non-oxidizing atmosphere, thereby obtaining a sintered copper body.

According to the method of manufacturing a sintered copper body having this constitution, the clay-like composition for forming a sintered copper body is used which includes a powder constituent containing a copper-containing metal powder which contains copper and a copper-containing oxide powder which contains copper; a binder; and water, wherein the amount of oxygen contained in the powder constituent is in a range of from 4 mass % to 8 mass %. Accordingly, when the baking is performed in the reduction atmosphere or the non-oxidizing atmosphere, it is possible to combust and remove the binder by using oxygen contained in the powder constituent.

In addition, since the baking is performed in the reduction atmosphere or the non-oxidizing atmosphere, an oxide film is suppressed from being generated on the surface of the manufactured sintered copper body.

It is preferable that the object be dried and then baked in the reduction atmosphere or the non-oxidizing atmosphere at a baking temperature in a range of from 800° C. to 1000° C. for 30 minutes to 180 minutes, thereby obtaining a sintered copper body.

According to the method of manufacturing a sintered copper body constituted in this manner, the baking conditions of the object of the clay-like composition for forming a sintered copper body is restricted as described above. Accordingly, it is possible to reliably perform the baking by removing the binder.

In the method of manufacturing the sintered copper body, the baking is performed while the object is buried in activated carbon.

According to the method of manufacturing a sintered copper body constituted in this manner, it is possible to promote the baking of the object by the reduction caused by the activated carbon. In addition, it is possible to reliably perform the baking with simple facilities.

According to the present invention, it is possible to provide the clay-like composition for forming a sintered copper body (copper clay) that can be subjected to the main baking in the non-oxidizing atmosphere without being subjected to the pre-baking in the atmosphere, the powder for the clay-like composition for forming a sintered copper body, the method of manufacturing the clay-like composition for forming a sintered copper body, the sintered copper body, and the method of manufacturing the sintered copper body.

DETAILED DESCRIPTION OF THE INVENTION

Figure 1:
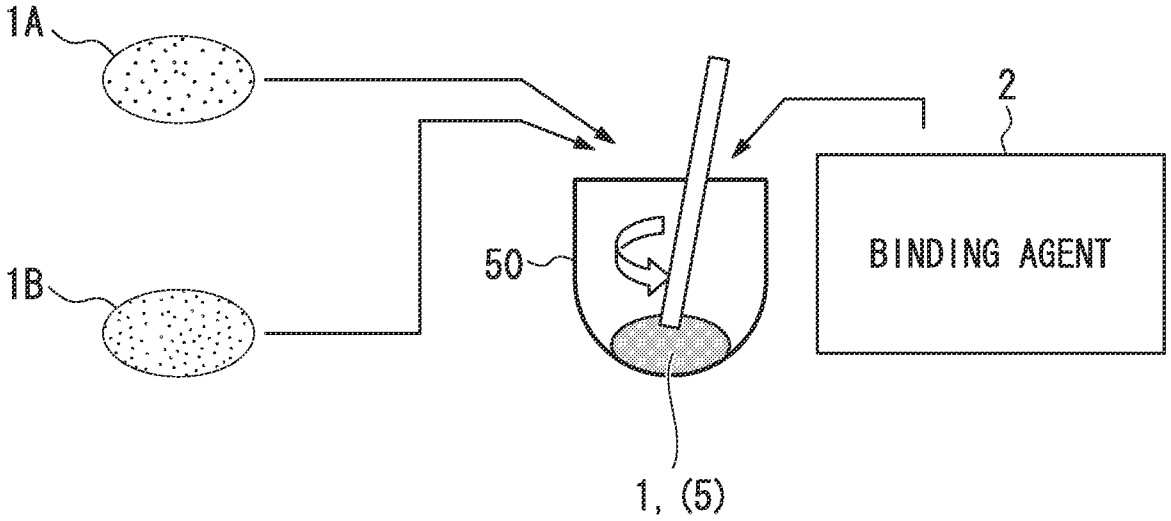
FIG. 1 is a schematic view illustrating a method of manufacturing a clay-like composition for forming a sintered copper body according to the present invention.

Hereinafter, an embodiment of the clay-like composition for forming a sintered copper body, powder for the clay-like composition for forming a sintered copper body, the method of manufacturing the clay-like composition for forming a sintered copper body, the sintered copper body, and the method of manufacturing the sintered copper body according to the present invention will be described with appropriate reference to drawings.

In the present embodiment, for the description, the clay-like composition for forming a sintered copper body is called copper clay, and the powder for the clay-like composition for forming a sintered copper body is called powder for copper clay.

[Powder for Copper Clay]

The powder for copper clay as the present embodiment contains copper-containing metal powder which contains copper and copper-containing oxide powder which contains copper. In addition, the oxygen amount in the powder for copper clay is in a range of from 4 mass % to 8 mass %, may be in a range of from 4 mass % to 6 mass %.

In the powder for copper clay according to the present embodiment, reduced Cu powder or the like is applicable as the copper-containing metal powder. In addition, as the copper-containing oxide powder, CuO powder or $Cu_2O$ powder is applicable. These powders are put in a kneading apparatus so as to be mixed and pulverized, whereby the respective powders are uniformly mixed, and the particles of the respective powders are adjusted to have a certain particle diameter.

Therefore, in the present embodiment, it is preferable to coat the inner wall of the stainless steel kneading container of the kneading apparatus with CrN. Since CrN coating is excellent not only in abrasion resistance but in lubricating properties, it is possible to inhibit Fe from being mixed into the powder for copper clay.

When the CuO powder is used as the copper-containing oxide powder, it is preferable that the amount of the CuO powder in the powder for copper clay be in a range of from 20 mass % to 40 mass %, the amount of the CuO powder is more preferable in a range of from 20 mass % to 30 mass %.

In addition, when the $Cu_2O$ powder is used as the copper-containing metal powder, it is preferable that the amount of the $Cu_2O$ powder in the powder for copper clay be in a range of from 36 mass % to 71 mass %, the amount of the $Cu_2O$ powder is more preferable in a range of from 36 mass % to 54 mass %.

Herein, in the present embodiment, the CuO powder is used as the copper-containing oxide powder.

In the present embodiment, there is no particular limitation on the particle diameter of the Cu powder and the CuO powder. However, the particle diameter is suitably set to the following range, in consideration of all properties such as formability shown when the copper clay is obtained by adding a binder, water, and the like to the powder and kneading the mixture.

The average particle diameter of the Cu powder is preferably 25 μm or less. If the average particle diameter of the Cu powder exceeds 25 μm, the sintering property of the powder deteriorates. Accordingly, a long baking time is required, and there is a possibility that the workability of the sintered copper body may be negatively affected, which is not preferable.

The lower limit of the average particle diameter of the Cu powder is not particularly specified. However, if the average particle diameter of the Cu powder is 1 μm or less, there is a concern that the costs of industrial production may increase, and the limitation of an apparatus also needs to be considered. Accordingly, it is preferable to set the lower limit to 1 μm.

In addition, in order to obtain the above-described operations and effects, it is preferable that the average particle diameter of the Cu powder be in a range of from 3 μm to 10 μm.

The average particle diameter of the CuO powder is preferably 25 μm or less. If the average particle diameter of the CuO powder exceeds 25 μm, the sintering property of the powder deteriorates similarly to the case of the Cu powder. Accordingly, a long baking time is required, and there is a possibility that the workability of the sintered copper body may be negatively affected, which is not preferable.

The lower limit of the average particle diameter of the CuO powder is not particularly specified similarly to the Cu powder. However, it is preferable to set the lower limit of the average particle diameter of the CuO powder to 1 μm, from the viewpoint of the limitation of an apparatus and costs of industrial production.

In addition, in order to obtain the above-described operations and effects, it is preferable that the average particle diameter of the CuO powder be in a range of from 3 μm to 10 μm.

In the present embodiment, the average particle diameter of the Cu powder and the CuO powder constituting the powder for copper clay is limited to be equal to or less than a predetermined particle diameter as described above, whereby the sintering property shown when the object of the copper clay is baked improves. Therefore, it is possible to perform the baking described later at a low temperature.

As a method of measuring the average particle diameter of the Cu powder and the CuO powder, a well-known microtrack method can be used, for example. Herein, in the present embodiment, d50 (median diameter) is taken as the average particle diameter.

[Copper Clay]

Next, the copper clay of the present embodiment will be described.

The copper clay according to the present embodiment includes the Cu powder, the CuO powder, a binder, and water, and optionally, a surface active agent or fatty substance are added thereto.

Herein, a mixing ratio (mass ratio) B/A between the Cu powder and CuO powder (A) and the binder and water (B) is in a range of $2/10 \leq B/A \leq 3/10$. In the present embodiment, the mixing ratio (mass ratio) B/A is set to 2.5/10.

There is no particular limitation on the binder used for the copper clay according to the present embodiment, and for example, it is preferable to constitute the binder with a combination of at least 1 or 2 or more kinds among a cellulose-based binder, a polyvinyl compound-based binder, an acryl compound-based binder, a wax-based binder, a resin-based binder, starch, gelatin, and flour. In addition, in the above binders, it is most preferable to use the cellulose-based binder, particularly, a water-soluble cellulose.

There is no particular limitation on the surface active agent, and it is possible to use normal surface active agents (for example, polyethylene glycol and the like).

In addition, there is no particular limitation on the type of the fatty substance, and examples thereof include an organic acid (oleic acid, stearic acid, phthalic acid, palmitic acid, sebacic acid, acetylcitric acid, hydroxybenzoic acid, lauric acid, myristic acid, caproic acid, enanthic acid, butyric acid and capric acid), an organic acid ester (an organic acid ester including a methyl group, an ethyl group, a propyl group, a butyl group, an octyl group, a hexyl group, a dimethyl group, a diethyl group, an isopropyl group or an isobutyl group), higher alcohols (octanol, nonanol and decanol), polyhydric alcohols (glycerin, arabinitol and sorbitan), and an ether (dioctyl ether and didecyl ether).

Hereinafter, an example of a method of manufacturing the copper clay according to the present embodiment described above will be described with reference to the schematic view shown in FIG. 1.

The method of manufacturing a copper clay 5 according to the present embodiment contains the powder for copper clay 1 in a range of from 70 mass % to 83.3 mass % and further contains a binding agent including an organic binder and water in a range of from 16.7 mass % to 30 mass %. The amount of the powder for copper clay 1 is more preferable in a range of from 76.9 mass % to 80 mass %, and the amount of the binding agent is more preferable in a range of from 20 mass % to 23.1 mass %. Herein, to the binding agent, a surface active agent or fatty substance may be optionally added in addition to the organic binder and water.

As shown in FIG. 1, in the method of manufacturing the copper clay 5 described in the present embodiment, first, each of Cu powder 1A and CuO powder 1B is introduced to a kneading apparatus 50 in a specified amount. At this time, for example, 78 mass % of the Cu powder 1A (average particle diameter of 10 μm measured by microtrack method; atomized copper powder manufactured by Fukuda Metal Foil & Powder Co., Ltd.) and 22 mass % of the CuO powder 1B (average particle diameter of 5 μm measured by microtrack method; manufactured by Kishida Chemical Co., Ltd., purity of 97% or higher) are introduced.

Thereafter, the respective material powder is kneaded in the kneading apparatus 50, thereby obtaining the powder for copper clay 1. At this time, there is a concern that Fe may be mixed into the powder from the inner wall of the stainless steel kneading container of the kneading apparatus 50. Accordingly, in the present embodiment, a container having the inner wall coated with CrN is used as the stainless steel kneading container of the kneading apparatus 50. Since the CrN coating is excellent not only in the abrasion resistance but in the lubricating property, it is possible to inhibit Fe from being mixed into the powder.

Subsequently, as shown in FIG. 1, a binding agent 2 is added to the powder for copper clay 1 in the kneading apparatus 50.

Herein, the binding agent 2 is obtaining by mixing the organic binder (11 mass % to 17 mass %), the fatty substance (5 mass % or less), the surface active agent (2 mass % or less), and water as the remainder.

Thereafter, the powder for copper clay 1 and the binding agent 2 are mixed and kneaded in the kneading apparatus 50, thereby obtaining the copper clay 5. Herein, for example, the amount of the binding agent 2 added can be adjusted to about {total weight of powder for copper clay 1:binding agent 2=10:2.5}. In the present embodiment, since the inner wall of the stainless steel kneading container of the kneading apparatus 50 is coated with CrN, it is possible to inhibit Fe from being mixed into the powder.

[Sintered Copper Body]

The sintered copper body according to the present embodiment is obtained by shaping and making the copper clay 5 constituted in the above-described manner into an arbitrary shape, and then baking the resultant in the conditions described later.

Hereinafter, an example of the method of manufacturing the sintered copper body according to the present embodiment described above will be described with reference to schematic views shown in FIGS. 2A to 2D.

In the method of manufacturing a sintered copper body 10 according to the present embodiment, the copper clay 5 constituted in the above-described manner is made into an arbitrary shape to obtain an object 51, the object 51 is then subjected to a drying treatment at a temperature from room temperature to 150° C. for 30 minutes to 24 hours, for example, and the object 51 is baked in the reduction atmosphere or the non-oxidizing atmosphere at 800° C. to 1000° C. for 30 minutes to 180 minutes, thereby obtaining the sintered copper body 10. Herein, as a method of performing the baking, it is possible to use a method in which the object 51 is buried in activated carbon, and then baked as it is at from 800° C. to 1000° C. for 30 minutes to 180 minutes.

Figure 2A:
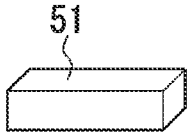
FIGS. 2A to 2D is a schematic view illustrating a method of manufacturing a sintered copper body using the clay-like composition for forming a sintered copper body according to the present invention.

First, as shown in FIG. 2A, the copper clay 5 is shaped and made into an arbitrary shape by, for example, a mechanical process using a stamper, press molding, extrusion molding, or the like, or a manual process of a worker, thereby obtaining the object 51.

Figure 2B:
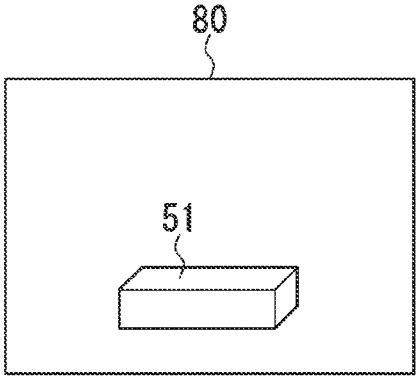

Thereafter, as shown in FIG. 2B, the object 51 is introduced to an electric furnace 80, followed by drying a treatment, thereby removing moisture or the like.

As the drying temperature at this time, it is preferable that the drying temperature be set to be, for example, in a range of from room temperature or about 80° C. to 150° C., from the viewpoint of an effective drying treatment. The time for performing drying treatment is set to, for example, a range of from 30 minutes to 720 minutes, and more preferably 30 minutes to 90 minutes, from the same viewpoint. For example, the drying treatment can be performed under conditions in which a drying temperature is about 100° C. and a drying time is about 60 minutes.

Figure 2C:
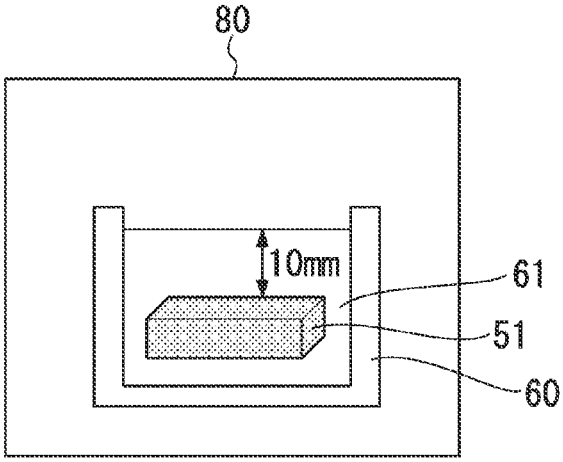

Subsequently, as shown in FIG. 2C, the object 51 is baked, thereby obtaining the sintered copper body 10. At this time, since the binder included in the copper clay is combusted using oxygen of CuO included in the powder for copper clay, it is possible to remove the binder. Herein, "using oxygen of CuO" refers to a phenomenon in which CuO emits oxygen by thermal decomposition during baking, and the oxygen contributes to the combustion of the organic binder.

In the present embodiment, by using the apparatus shown in the drawing as an example, it is possible to employ a method of manufacturing the sintered copper body 10 by baking the object 51.

At this time, first, the object 51 is buried in an activated carbon 61 charged into a ceramic baking container 60. At this time, in order to prevent the object 51 from being completely buried and being exposed outside when the activated carbon is combusted, it is preferable to secure a distance of about 10 mm or more between the surface of the activated carbon 61 in the baking container 60 and the object 51.

Subsequently, the baking container 60 in which the object 51 has been buried in the activated carbon 61 is introduced to the electric furnace 80, and heated at a temperature in a range of from 800° C. to 1000° C. for 30 minutes to 180 minutes as described above, thereby performing baking.

Figure 2D:
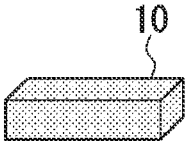

Thereafter, for example, as shown in FIG. 2D, the sintered copper body 10 obtained by the baking is subjected to a post process such as surface polishing and decoration treatment, thereby obtaining various products.

As described so far, according to the copper clay 5 as the present embodiment, the oxygen amount in the powder constituent containing the Cu powder and the CuO powder is from 4 mass % to 8 mass %. Accordingly, it is possible to combust the binder using oxygen contained in the powder constituent. As a result, even if the baking is performed in the reduction atmosphere by using the activated carbon as in the present embodiment, it is possible to combust and remove the binder. Therefore, it is possible to omit the pre-baking step performed in the atmosphere. In addition, since the oxygen is not included more than is necessary, copper oxide is suppressed from remaining inside the sintered copper body.

Moreover, as described above, since the baking can be performed in the reduction atmosphere, it is possible to inhibit the oxide film from being generated on the surface of the sintered copper body. Consequently, problems caused by the oxide film can be prevented in advance.

In the present embodiment, the amount of the CuO powder in the powder constituent is in a range of from 20 mass % to 40 mass %. Accordingly, the oxygen amount in the powder constituent can be set to 4 mass % to 8 mass %, and as a result, even if the baking is performed in the reduction atmosphere, it is possible to reliably combust and remove the binder.

In the present embodiment, the mixing ratio (mass ratio) B/A between the Cu powder and CuO powder (A) and the binder and water (B) is in a range of $2/10 \leq B/A \leq 3/10$, and specifically, in a range of B/A=2.5/10. Accordingly, the formability of the copper clay is secured, the binder is not included more than is necessary, and it is possible to reliably remove the binder by using the oxygen contained in the powder for copper clay.

In the present embodiment, the particle diameter of the CuO powder is from 1 μm to 25 μm, and the average particle diameter of the Cu powder is from 1 μm to 25 μm. Accordingly, it is possible to secure the sintering property of these powders and to improve the mechanical strength, elongation, and the like of the sintered copper body.

The present embodiment is constituted such that the baking is performed while the object is buried in the activated carbon. Accordingly, by the reduction caused by the activated carbon, the baking of the object can be promoted. In addition, it is possible to reliably perform the baking with simple facilities.

Moreover, in the present embodiment, the baking is performed in the reduction atmosphere at a baking temperature in a range of from 800° C. to 1000° C. for 30 minutes to 180 minutes. Accordingly, it is possible to reliably perform the baking.

So far, the embodiments of the present invention have been described, but the invention is not limited thereto. The invention can be appropriately modified within a range that does not depart from the technical scope of the invention.

For example, the powder for copper clay including the Cu powder and the CuO powder has been described, but the invention is not limited thereto. As the copper-containing oxide powder, $Cu_2O$ powder may be used. Alternatively, the copper-containing oxide powder may include both the CuO powder and the $Cu_2O$ powder.

In the examples shown in FIGS. 2A to 2D, for the convenience of diagrammatic illustration and description, the object 51 obtained by making the copper clay 5 into a shape and the sintered copper body 10 were formed into an approximate block shape. However, needless to say, the object 51 and the sintered copper body 10 can be formed into various artistic shapes.

In addition, in the present embodiment, the example was described in which the electric furnace was used in the respective steps of the drying treatment and baking, but the invention is not limited thereto. For example, it is possible to use any apparatus such as a gas heating apparatus without any limitation, as long as heating conditions of the apparatus can be stably controlled.

Example

Hereinafter, the clay-like composition for forming a sintered copper body, the powder for the clay-like composition for forming a sintered copper body, the method of manufacturing the clay-like composition for forming a sintered copper body, the sintered copper body, and the method of manufacturing the sintered copper body of the present invention will be described in more detail by using examples, but the present invention is not limited to the examples.

First, the powder for the clay-like composition for forming a sintered copper body (hereinafter, referred to as powder for copper clay) was manufactured in the following sequence. In manufacturing the powder for copper clay, Cu powder (average particle diameter of 10 μm measured by microtrack method; atomized copper powder manufactured by Fukuda Metal Foil & Powder Co., Ltd.), CuO powder (average particle diameter of 5 μm measured by microtrack method; reagent manufactured by Kishida Chemical Co., Ltd., purity of 97% or higher), and $Cu_2O$ powder (average particle diameter of 5 μm manufactured by microtrack method; reagent manufactured by Kishida Chemical Co., Ltd., purity of 97% or higher) were mixed by means of the kneading apparatus shown in FIG. 1, thereby obtaining the powder for copper clay of the constitution shown in Table 1. At this time, the stainless steel kneading container of the kneading apparatus used had the inner wall coated with CrN.

Herein, the oxygen concentration in the obtained powder for copper clay was measured by a high-furnace heating-infrared absorption method. The measured results are shown in Table 1.

Next, while the powder for copper clay obtained in the above sequence remained in the kneading apparatus, a binding agent which was obtained by mixing a binder, water, a surface active agent, and fatty substance was further added thereto, followed by kneading, thereby manufacturing the clay-like composition for forming a sintered copper body (hereinafter, referred to as copper clay).

Herein, the binding agent was obtained by mixing 15 mass % of methyl cellulose as an organic binder, 3 mass % of olive oil, which is a kind of an organic acid, as fatty substance, 1 mass % of polyethylene glycol as a surface active agent, and water as the remainder.

D: The cross-section showed black due to the binder residue (carbon).

TABLE 1

| | Powder composition for clay (mass %) | | | Oxygen concentration in | Pre-baking | Main baking | Result of cross-section |
|---|---|---|---|---|---|---|---|
| | Metal Cu | CuO | $Cu_2O$ | powder for clay* | (atmosphere) | (reduction) | observation |
| Sample 1 | 100 | — | — | 0 | 500° C. × 0.5 h | 970° C. × 1 h | C |
| | | | | | None | 970° C. × 1 h | D |
| Sample 2 | 90 | 10 | — | 2.0 | 500° C. × 0.5 h | 970° C. × 1 h | C |
| | | | | | None | 970° C. × 1 h | D |
| Sample 3 | 78 | 22 | — | 4.4 | 500° C. × 0.5 h | 970° C. × 1 h | C |
| | | | | | None | 970° C. × 1 h | A |
| Sample 4 | 60 | 40 | — | 8.0 | 500° C. × 0.5 h | 970° C. × 1 h | C |
| | | | | | None | 970° C. × 1 h | B |
| Sample 5 | — | 100 | — | 20.1 | 500° C. × 0.5 h | 970° C. × 1 h | C |
| | | | | | None | 970° C. × 1 h | C |
| Sample 6 | 90 | — | 10 | 1.1 | 500° C. × 0.5 h | 970° C. × 1 h | C |
| | | | | | None | 970° C. × 1 h | D |
| Sample 7 | 60 | — | 40 | 4.5 | 500° C. × 0.5 h | 970° C. × 1 h | C |
| | | | | | None | 970° C. × 1 h | A |
| Sample 8 | 40 | — | 60 | 6.7 | 500° C. × 0.5 h | 970° C. × 1 h | C |
| | | | | | None | 970° C. × 1 h | A |
| Sample 9 | — | — | 100 | 11.2 | 500° C. × 0.5 h | 970° C. × 1 h | C |
| | | | | | None | 970° C. × 1 h | C |

*Oxygen concentration was measured by a high-furnace heating-infrared absorption method (mass %).

In addition, the mixing ratio (mass ratio) B/A between the powder for copper clay (A) and the binder and water (B) was B/A=2.5/10.

The obtained copper clay was made into a shape, thereby preparing a prismatic object (before baking) having dimensions of a length of about 30 mm, a width of about 3 mm, and a thickness of about 3 mm. Two objects were manufactured from 1 kind of copper clay.

Thereafter, as shown in FIG. 2B, the objects were introduced to an electric furnace (Orton manufactured by Evenheat Kiln Inc.), followed by drying treatment under conditions in which the drying temperature was 100° C. and the drying time was 60 minutes, thereby removing moisture or the like included in the object.

One of the objects was subjected to the pre-baking at 500° C. for 30 minutes in the atmosphere. The pre-baking was omitted for the other object.

Subsequently, the objects were baked, whereby copper sintered bodies were prepared.

Specifically, as shown in FIG. 2C, a ceramic baking container in which activated carbon was charged was prepared, and the respective objects were buried in the activated carbon. At this time, the distance from the surface of the activated carbon to the respective objects was set to about 10 mm.

Thereafter, the baking container in which the respective objects had been buried in the activated carbon was introduced to the electric furnace, followed by main baking under conditions of 970° C. for 1 hour. As a result, prismatic copper sintered bodies were prepared.

The cross-section of the prepared sintered copper body was observed so as to confirm the state where the copper oxide and binder residue remained, and the evaluation of the state was performed in the following manner. The evaluation results are shown in Table 1.

A: The cross-section showed copper color. Oxide and binder residue were not confirmed.

B: 1/10 to 1/2 of the range of the cross-section showed black due to copper oxide.

C: More than 1/2 of the range of the cross-section showed black due to copper oxide.

Among all of the copper clays, the cross-section of the copper clay having undergone the pre-baking showed black due to the copper oxide. Presumably, this was because the metal Cu was oxidized by the pre-baking performed in the atmosphere, and the copper oxide inside the copper clay failed to be reduced even in the main baking performed thereafter in the reduction atmosphere.

In addition, the cross-section of the copper clay constituted with 100% of CuO powder and the copper clay constituted with 100% of $Cu_2O$ powder, for which the pre-baking was omitted, also showed black due to the copper oxide.

On the other hand, the binder residue was observed in the cross-section of the copper clay constituted with 100% of Cu powder, the copper clay in which 10% of the CuO powder was mixed, and the copper clay in which 10% of the $Cu_2O$ powder was mixed, for which the pre-baking was omitted. Presumably, the removal of the binder was insufficient.

Contrary to this, the cross-sections of the copper clay in which 22% of the CuO powder was mixed, the copper clay in which 40% of the $Cu_2O$ powder was mixed, and the copper clay in which the 60% of $Cu_2O$ powder was mixed, for which the pre-baking was omitted, showed a copper color, and the copper oxide and binder residues were not confirmed. Moreover, in a portion of the copper clay in which 40% of the CuO powder was mixed, for which the pre-baking was omitted, the copper oxide remained. However, the binder was not confirmed.

From the above results of the present embodiment, it was confirmed that according to the copper clay in which the amount of the CuO powder is from 20 mass % to 40 mass %, or the amount of the $Cu_2O$ powder is from 36 mass % to 71 mass %, it is possible to sufficiently remove the binder even if the pre-baking is omitted and to prevent formation of a copper oxide residue.

Next, the influence of the Fe amount was evaluated in the following manner.

The powder for copper clay and the copper clay were prepared in the same manner as in Sample 3 and taken as Sample 10 and 11, except that a minute amount of Fe powder was added to the powder for copper clay. The copper clays of Sample 3 and the Sample 10 and 11 were washed with boiling water at 90° C. or higher so that the organic binder, surface active agent, and fatty substance were removed, and then samples of a predetermined amount (about 10 g) necessary for a quantitative analysis were collected. Subsequently, the quantitative analysis of Fe included in the sample for analysis (powder for copper clay) was performed by an ICP analysis.

Thereafter, the copper clay was made into a shape, thereby preparing a wire-like object having dimensions (before baking) of a diameter of about 1.2 mm and a length of about 50 mm. This wire-like object was subjected to the pre-baking and main baking in the same manner as described above, and the tensile strength of the thus obtained wire-like sintered copper body was measured. To determine the tensile strength, an AUTOGRAPH AG-X manufactured by Shimadzu Corporation was used to measure a stress trajectory with a tensile rate of 5 mm/min, and the stress at a moment when a test specimen was broken was measured.

The results of the evaluation are shown in Table 2.

TABLE 2

| | Fe amount ppm | Pre-baking (atmosphere) | Tensile strength $N/mm^2$ |
|---|---|---|---|
| Sample 3 | 75 | None | 164 |
| Sample 10 | 182 | None | 160 |
| Sample 11 | 1071 | None | 66 |

It can be understood that the Samples 3 and 10 has an excellent sintering property and mechanical strength of the sintered copper body, compared to Sample 11, since the Fe amount in the powder for copper clay (and in a powder constituent of the copper clay) is as small as 1000 ppm or less.

Furthermore, it can be understood that the tensile strength is improved remarkably when the Fe amount in the powder for copper clay is 200 ppm or less, by comparison of measurement values of Samples 3 and 10 with a measurement value of Sample 11.

What is claimed is:

1. A composition for forming a sintered copper body comprising:

a powder constituent containing a copper-containing metal powder which contains copper and a copper-containing oxide powder which contains copper;

a binder; and water, wherein an amount of oxygen contained in the powder constituent is in a range of from 4 mass % to 8 mass %, an amount of Fe in the powder constituent is 1000 ppm or less, wherein an average particle diameter of the copper-containing oxide powder is from 3 μm to 10 μm, and wherein an average particle diameter of the copper-containing metal powder is from 3 μm to 10 μm.

2. The composition for forming a sintered copper body according to claim 1, wherein CuO powder is used as the copper-containing oxide powder, and the amount of the CuO powder in the powder constituent is in a range of from 20 mass % to 40 mass %.

3. The composition for forming a sintered copper body according to claim 1, wherein $Cu_2O$ powder is used as the copper-containing oxide powder, and the amount of the $Cu_2O$ powder in the powder constituent is in a range of from 36 mass % to 71 mass %.

4. The composition for forming a sintered copper body according to claim 1, wherein a mixing ratio (mass ratio) B/A between the powder constituent (A) and the binder and water (B) is in a range of $2/10 \leq B/A \leq 3/10$.

5. The composition for forming a sintered copper body according to claim 1, wherein the average particle diameter of the copper-containing oxide powder is from 5 μm to 10 μm.

6. The composition for forming a sintered copper body according to claim 1, wherein the average particle diameter of the copper-containing metal powder is from 5 μm to 10 μm.

7. The composition for forming a sintered copper body according to claim 1, further comprising at least any one of fatty substance and a surface active agent.

8. The composition for forming a sintered copper body according to claim 1, wherein the binder is at least 1 or 2 or more kinds of binder(s) selected from a group consisting of a cellulose-based binder, a polyvinyl compound-based binder, an acryl compound-based binder, a wax-based binder, a resin-based binder, starch, gelatin, and flour.

9. The composition for forming a sintered copper body according to claim 1, wherein CuO powder is used as the copper-containing oxide powder, and the average particle diameter of the CuO powder is from 3 μm to 10 μm, and Cu powder is used as the copper-containing metal powder, and the average particle diameter of the Cu powder is from 3 μm to 10 μm.

10. A sintered copper body which is obtained by baking the composition for forming a sintered copper body according to claim 1.

11. A powder for a composition for forming a sintered copper body comprising:

a copper-containing metal powder which contains copper; and a copper-containing oxide powder which contains copper, wherein the oxygen amount in the powder for the clay-like composition is in a range of from 4 mass % to 8 mass %, an amount of Fe in the powder for the clay-like composition is 1000 ppm or less, wherein an average particle diameter of the copper-containing oxide powder is from 3 μm to 10 μm, and wherein an average particle diameter of the copper-containing metal powder is from 3 μm to 10 μm.

12. The powder for a composition for forming a sintered copper body according to claim 11, wherein CuO powder is used as the copper-containing oxide powder, and the amount of the CuO powder is in a range of from 20 mass % to 40 mass %.

13. The powder for a composition for forming a sintered copper body according to claim 11, wherein $Cu_2O$ powder is used as the copper-containing oxide powder, and the amount of the $Cu_2O$ powder is in a range of from 36 mass % to 71 mass %.

14. The powder for a composition for forming a sintered copper body according to claim 11, wherein the average particle diameter of the copper-containing oxide powder is from 5 μm to 10 μm.

15. The powder for a composition for forming a sintered copper body according to claim 11, wherein the average particle diameter of the copper-containing metal powder is from 5 μm to 10 μm.

16. A method of manufacturing a composition for forming a sintered copper body comprising mixing together a copper-containing metal powder which contains copper, a copper-containing oxide powder which contains copper, a binder, and water in a stainless steel kneading container having an inner wall coated with CrN, wherein, an amount of oxygen contained in a powder constituent containing the copper-containing metal powder and the copper-containing oxide powder is in a range of from 4 mass % to 8 mass %, and an amount of Fe in the powder constituent is 1000 ppm or less.

17. A method of manufacturing a sintered copper body comprising, making the composition for forming a sintered copper body according to claim 1 into an arbitrary shape to obtain an object, and drying the object and then baking the object in a reduction atmosphere or a non-oxidizing atmosphere, thereby obtaining a sintered copper body.

18. The method of manufacturing a sintered copper body according to claim 17, wherein the drying and baking steps are performed at a temperature in a range of from 800° C. to 1000° C. for 30 minutes to 180 minutes.

19. The method of manufacturing a sintered copper body according to claim 17, wherein the object is baked while being buried in activated carbon.

* * * * *